US005573227A

United States Patent [19]

Hemauer et al.

[11] Patent Number: 5,573,227

[45] Date of Patent: Nov. 12, 1996

[54] GUARDRAIL STANCHION MOUNTED ONTO BUILDING FRAME

[76] Inventors: Thomas J. Hemauer, 629 Canary St.; David Gasch, N. 4962 McHugh Rd., both of Chilton, Wis. 53014

[21] Appl. No.: 489,812

[22] Filed: Jun. 13, 1995

[51] Int. Cl.[6] ..... E04G 3/12

[52] U.S. Cl. ..... 256/65; 256/59; 256/DIG. 6

[58] Field of Search ..... 256/59, 65, DIG.6; 182/113

[56] References Cited

U.S. PATENT DOCUMENTS

| | | | |
|---|---|---|---|
| 3,901,481 | 8/1975 | Probst | 256/59 |
| 4,359,851 | 11/1982 | Daniels | 256/59 X |
| 4,666,131 | 5/1987 | Kettelkamp et al. | 182/113 X |
| 4,669,577 | 6/1987 | Werner | 182/113 |
| 5,067,586 | 11/1991 | Myers | 182/113 X |
| 5,221,076 | 6/1993 | Züst | 182/113 X |
| 5,353,891 | 10/1994 | Griek et al. | 182/113 X |

FOREIGN PATENT DOCUMENTS

| | | | |
|---|---|---|---|
| 2059251 | 7/1992 | Canada | 256/DIG. 6 |
| 1280836 | 11/1962 | France | 182/113 |
| 2558874 | 8/1985 | France | 256/65 |
| 677255 | 4/1991 | Switzerland | 182/113 |

*Primary Examiner*—Anthony Knight

[57] ABSTRACT

A stanchion, a row of which are to be mounted at spaced intervals along the facia board and rafters of the frame of a building under construction. Stanchions support guardrails which are nailed through slots in rail holders on the stanchions, to provide a fall protection system for workers on the roof under construction. The bracket part of each stanchion is attached to the facia board and also to a rafter of the building frame, thus spreading the force caused by a falling person or large object between both facia and rafters, providing maximum strength. The vertical post and the rails stand out from the edge of the roof, and therefore in no way interfere with the complete roofing process, including sheathing, gutter apron or de-edging, tar papering, and all shingling. Siding operation can also be done while the stanchions are in place.

18 Claims, 5 Drawing Sheets

GUARDRAIL STANCHION MOUNTED ONTO BUILDING FRAME

BACKGROUND—FIELD OF INVENTION

This invention relates to a safety system of stanchions for the support of guardrails to prevent workers from falling off of the roofs of buildings under construction.

BACKGROUND—DESCRIPTION OF PRIOR ART

Preventing roof workers and others from falling off of buildings has long been a concern in the construction industry. Recently, the Department of Labor's Occupational Health and Safety Administration has issued new requirements for the protection of these workers. One possibility is a harness and line fall-arrest system, but anchored harnesses can be uncomfortable and restrict movement. More importantly, they depend entirely upon each person to remember to hook up each time he or she goes to the roof. On the other hand, stanchion and rail systems protect any number of workers who may be on the roof at one time. A problem that arises with the stanchion systems is that the posts and top rail must withstand a significant force, applied near the top edge, in any outward and downward direction. {See OSHA Safety Standards for Fall Protection in the Construction Industry, Federal Register Part III, 40734, Part 1926 Subpart M, 1926.502. Paragraph (3) states that, "Guardrail systems shall be capable of withstanding, without failure, a force of at least 200 pounds (890N) applied within 2 inches (5.1 cm.) of the top edge, in any outward or downward direction, at any point along the top edge."} This puts tremendous leverage on the anchor point of each stanchion to the building frame. In order to meet this strength requirement, many of these stanchions have brackets that interfere with the construction process in some way.

Please refer to the page entitled SLOPED ROOF RAILING SYSTEMS. This is from a booklet titled "OSHA's Subprt M", explaining the new OSHA regulations and given out by our local OSHA office. (There are no page numbers on the booklet.) This page shows four types of lumber rail and stanchion systems that may be constructed.

FIG. 1 shows a braced, L-shaped bracket, mounted to the side of a building below the roof line. This interferes with putting the siding onto the building while the bracket is in place.

FIG. 2 shows a straight horizontal bracket secured to a joist, but this one can interfere with the placement of the facia and gutter apron, which must be done before work on the roof can begin.

FIG. 3 shows a straight vertical bracket that projects through the roof. This does not allow workers to work on the edge of the roof. Also, this one interferes with the placement of siding, and leaves a hole in the roof sheathing when it is removed.

FIG. 4 shows a braced bracket that mounts over the vertical outside wall of the building frame. Again, this bracket interferes with placement of siding and eave material.

The next reference is a Catalog from Roofmaster Products Co, showing a set of stanchions and rails called "Eave Catchguard", PR20. The quote, "Eave Catchguard Rafter Bracket can be easily shingled over . . . ", indicates that it could only be applied to a building under construction after at least the part of the roof has been constructed.

U.S. Pat. No. 5,221,076 to Zust (1993) shows a protective system to be mounted into a roof gutter, and supported with roof anchors. The gutter, as well as the anchors will interfere with the roofing process of a building under construction.

U.S. Pat. No. 5,353,891 to Griek et al. (1994) teaches an assembly where the stanchions are mounted to a steel frame building.

U.S. Pat. No. 5,067,586 to Myers (1991) shows members that will interfere with the completion of both the roofing and siding processes.

U.S. Pat. No. 4,669,577 to Werner (1987) uses a screw clamp to mount the bracket to the building and is suited particularly for buildings with concrete floors.

U.S. Pat. No. 3,901,481 to Probst (1975) uses a roof plate nailed to the roof under the shingles. This cannot be put in place until the roof is at least partially sheathed.

U.S. Pat. No. 4,359,851 to Daniels (1982) shows a post bracket for a deck mounted to the outer horizontal board of a deck platform. If this bracket were mounted to the facia board of a roof frame, it could only be applied after the sheathing, gutter apron or de-edging, and bottom row of shingles have been applied.

U.S. Pat. No. 4,666,131 to Kettlekemp and Shafstall (1987) illustrates a bracket which attaches only to the rafter of a building with two closely spaced bolts. The application of a large force at the top of the stanchion could put too much pressure on these two bolts and split the rafter.

OBJECTS AND ADVANTAGES

Several objects and advantages of this stanchion are:

(a) to provide a fall protection system that will keep workers from falling off of the roofs of buildings under construction;

(b) to provide a fall protection system which will attach to the frame of a home or other building under construction and be able to support guardrails which will be able to withstand a substantial force applied in a downward and outward direction; and especially to meet OSHA regulations. {Department of Labor, OSHA specification 1926.502, Rules and Regulations, Safety Standards for the Fall Protection in the Construction Industry; Final Rule};

(c) to provide a fall protection system that can be attached to a frame of a building before the roofing process has begun, including sheathing, gutter apron or de-edging, and all shingling;

(d) to provide a fall protection system that when in place will not interfere with the siding process of the construction; thus the roofing and siding can be done independently or simultaneously; the stanchions must only be removed before the facia covet and soffit is applied, and these operations are not done by workers on the roof;

(e) to provide a fall protection system that can be attached to the frame of a building easily, removed easily, and reused for many years;

(f) to provide a fall protection system with components that are strong, durable, and easy and inexpensive to manufacture.

(g) to provide a fall protection system which can support several rails; the top one can be used as a handrail and the bottom one can be used as a toe board, and also to prevent tools and other objects from falling off and causing inconvenience or injury; Instead of rails, nylon webbing, netting, or the like can be used for the horizontal members.

SUMMARY OF THE INVENTION

Our invention is a stanchion which attaches to the facia board and rafter of the frame of a building under construction. A row of these stanchions, thus mounted at spaced intervals, and supporting guardrails, form a strong and reliable fall protection system for workers building the roof of the building. Conveniently, this system of stanchions and horizontal members will not interfere with the construction process.

LIST OF REFERENCE NUMERALS

| | |
|---|---|
| 10 | vertical post |
| 20A | top rail holder |
| 20B | middle rail holder |
| 20C | bottom rail holder |
| 21A, 21B and 21C | nail holes for rails |
| 200 | bracket assembly of invention |
| 210 | front bracket member |
| 220R | right facia nailing flange |
| 220Ra | right facia nailing flange attachment wing |
| 220Rb | right facia nailing flange nail hole wing |
| 220L | left facia nailing flange |
| 220La | left facia nailing flange attachment wing |
| 220Lb | left facia nailing flange nail hole wing |
| 222R | right facia flange nail hole |
| 222L | left facia flange nail hole |
| 230R | right bracket bottom connector plate |
| 230L | left bracket bottom connector plate |
| 240 | back bracket arm |
| 250 | rafter support arm |
| 252 | first rafter support arm nail hole |
| 254 | second rafter support arm nail hole |
| 256 | third rafter support arm nail hole |
| 42 | facia board of a building frame |
| 44 | rafter of a building frame |
| 46 | nails or spikes |
| 43A | top rail |
| 43B | middle rail |
| 43C | bottom rail, or toe board |
| A | angle formed where vertical post 10 meets front bracket member 210 |
| B | angle formed where vertical bracket arm 240 and rafter support arm 250 meet |
| 10' | vertical post identical to 10, but not joined to 210 |
| 100 | vertical sleeve to receive post 10' |
| 300 | netting |

DESCRIPTION OF THE PREFERRED EMBODIMENT OF THE INVENTION

Figure 1:
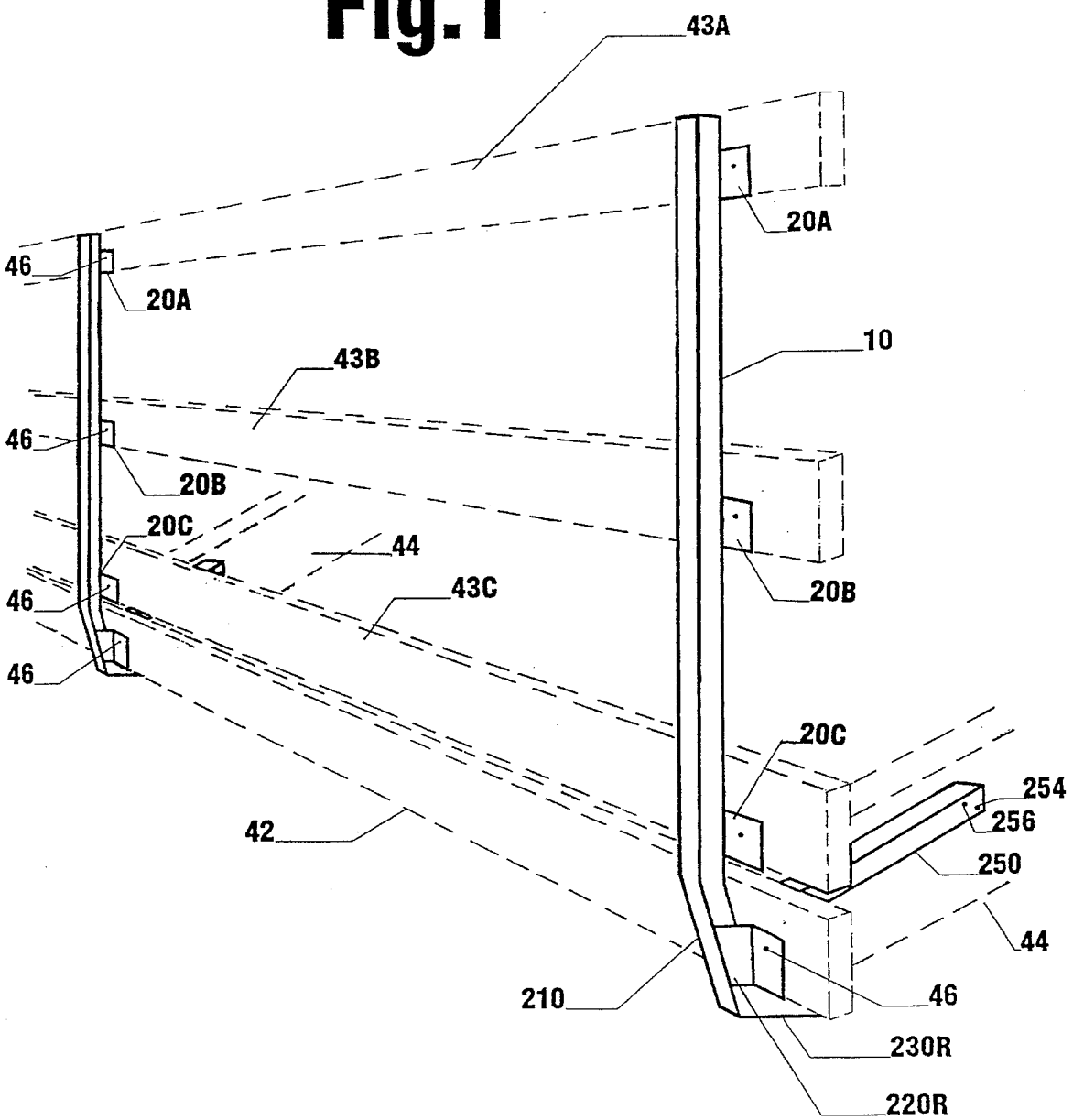
FIG. 1 is a perspective view of two of a row of stanchions of the present invention, holding guardrails, in place along one edge of a building frame.
Figure 5:
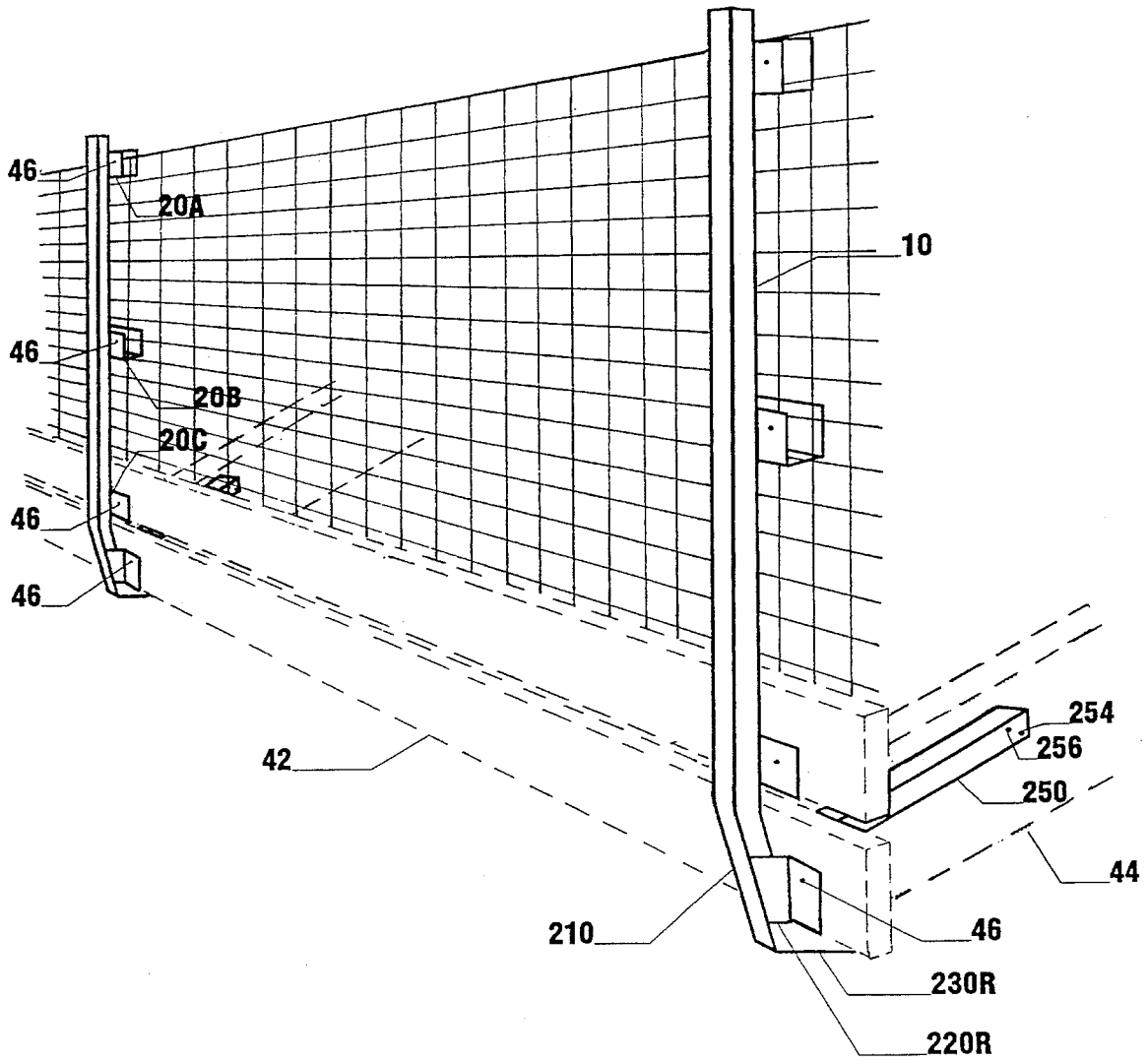
FIG. 5 is a perspective view similar to FIG. 1 showing netting attached to the posts.

FIG. 1 shows two of a row of stanchions of our invention mounted onto a frame of a building under construction, and supporting guardrails 43A, 43B, 43C. FIG. 5 shows netting 300 attached to the posts.

Figure 2:
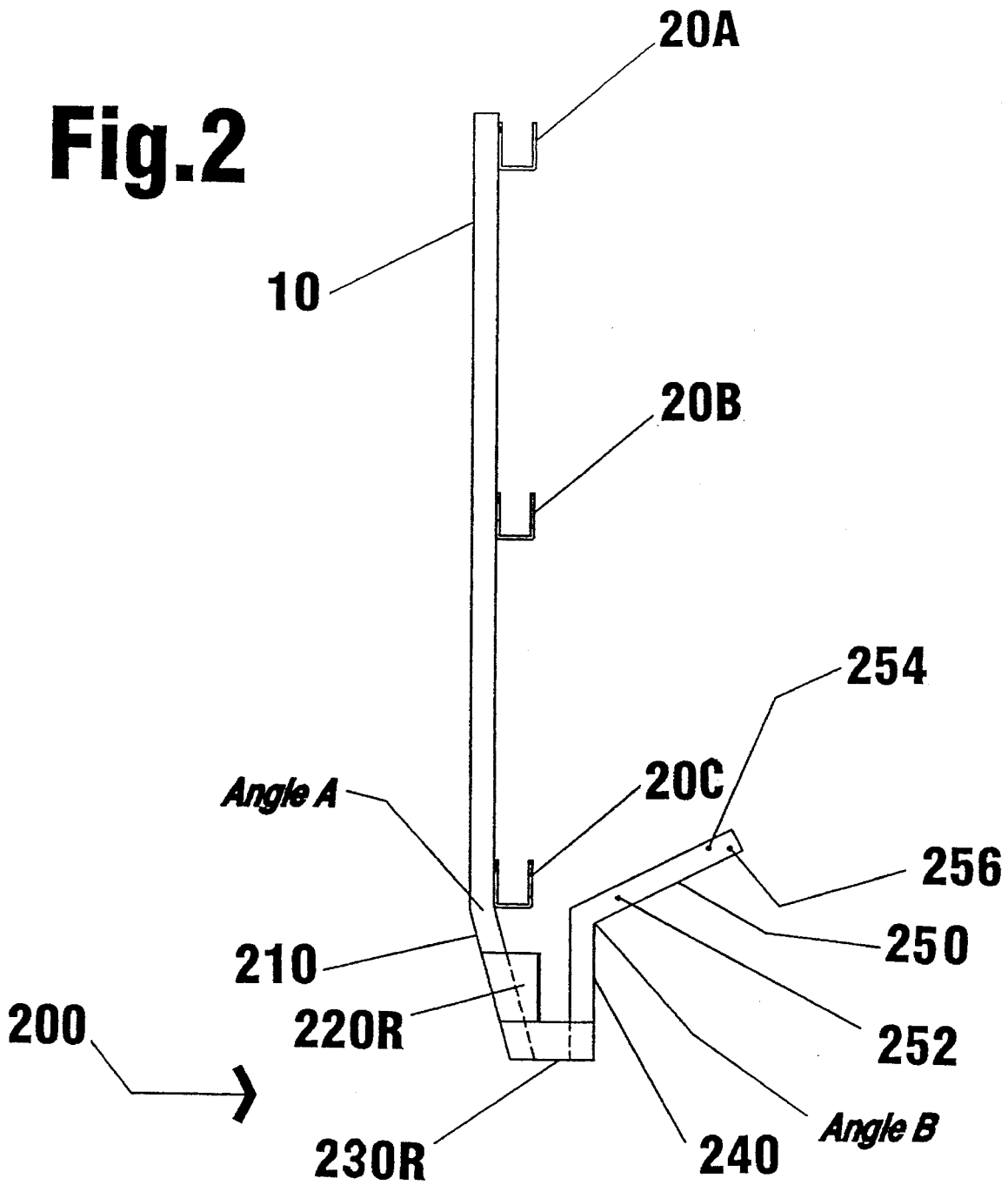
FIG. 2 is a side view of a stanchion.

FIG. 2 is a side view of a stanchion, the top part of which consists of a vertical post 10, made from square tube metal. To the inside edge of tubular post 10 are attached three guardrail holders 20A, 20B, and 20C, each made of plate metal, formed into a U-shape. Through the front edge of each of holders 20A, 20B and 20C are drilled a pair of nail holes 21A, 21B, and 21C, respectively. (These nail holes are not visible in this view. Please see FIG. 3.)

Below the bottom rail holder 20C is found the bracket assembly 200 of the invention. A front bracket member 210 angles downward and inward from the bottom end of vertical post 10, at angle A. This front bracket member is made of square tube metal. (Post 10 and front bracket member 210 may be fabricated from one length of tube metal bent at angle A, or two pieces joined together at A). To the right and left sides of the tube shaped front bracket member 210 are attached a right facia nailing flange 220R, and a left. facia nailing flange 220L respectively. Only flange 220R is evident in this view, and part of that is bent outwardly toward the viewer, which cannot be seen in this side perspective.

Extending horizontally from each side of the bottom of front bracket member 210 and across the bottom of bracket assembly 200 of the stanchion are a right and a left bracket bottom connector plates, 230R and 230L. Connector plates 230R and 230L are made of plate metal. Again, only 230R is showing in this FIG. 2. Extending vertically upwards between the other ends of bracket bottom connector plates 230R and 230L is a back bracket arm 240. Back bracket arm 240 is made of square tube metal. From the other end of back bracket arm 240 there extends, in an upward and outward direction, a rafter support arm 250, also made of square tube metal. (Back bracket arm 240 and rafter support arm 250 may be fabricated from one length of tube metal, bent at angle B, or they can be two separate lengths joined at angle B). All the way through the rafter support arm 250 there are drilled three rafter support nail holes 252, 254, and 256. Nail hole 252 is situated through rafter support arm 250 fairly close to its connection to back bracket arm 240. Nail hole 254 and nail hole 256 are located near the far end of rafter support arm 250. These three rafter support arm nail holes 252 254 and 256 are not aligned with each other.

Figure 3A:
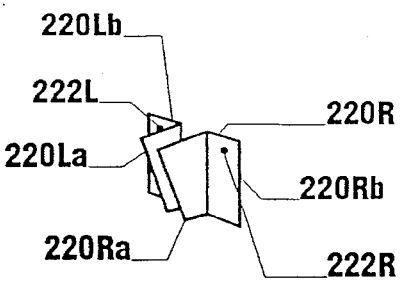
FIG. 3A is the perspective view of just the flanges.
Figure 3:
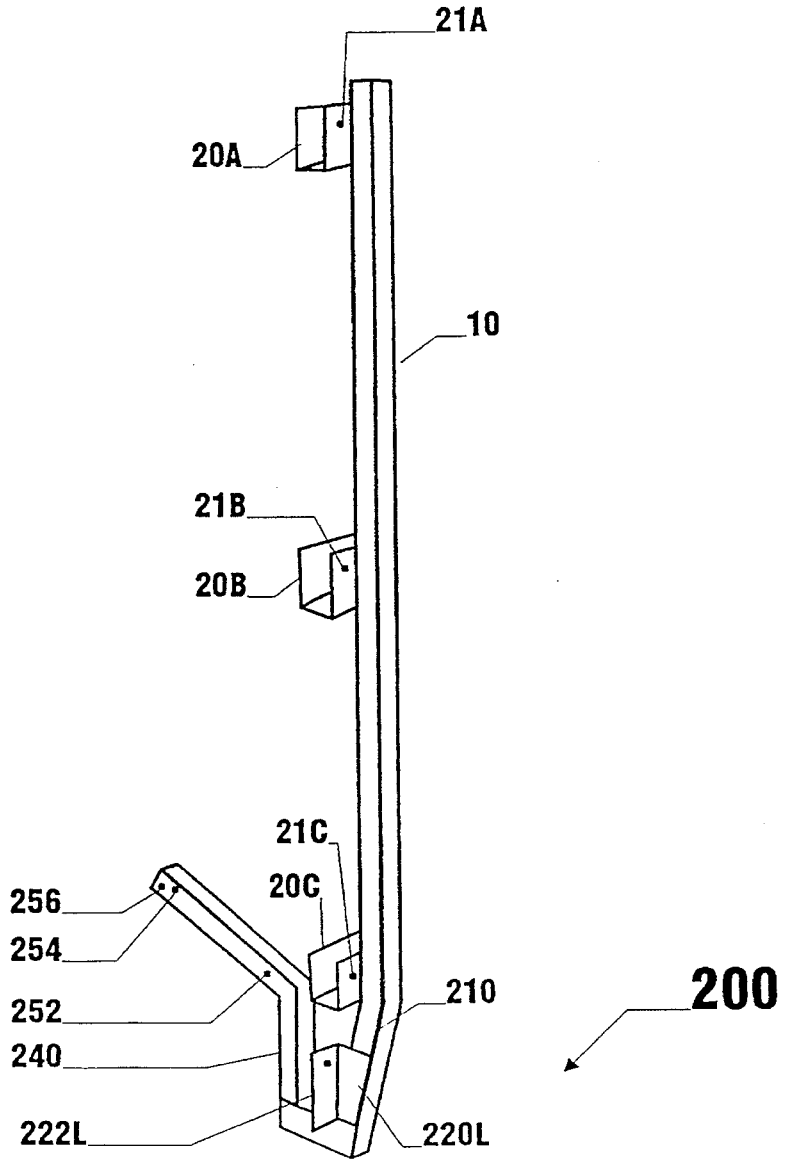
FIG. 3 is a perspective view of a stanchion.

FIG. 3 shows the stanchion in a perspective view. Attached to vertical post 10 are rail holders 20A, 20B, and 20C which can be seen better from this figure, along with the left one of each pair of nail holes 21A, 21B, and 21C.

FIG. 3A shows a perspective of both facia nailing flanges 220R and 220L standing alone. Both facia flanges 220R and 220L are made of plate metal which is bent at a 90 degree angle around a vertical axis, creating two wings. A wing 220Ra of flange 220R is welded or joined flush to the right side of front bracket member 210, and another wing 220Rb projects out to the right of front facia member 210 and contains a right facia flange nail hole 222R. Likewise, left flange 220L has one inside wing 220La which is joined to the left side of member 210, and another wing 220Lb, extending out to the left and containing a left facia flange nail hole 222L.

DESCRIPTION OF OPERATION—FIGS. 1

FIG. 1—A row of evenly spaced stanchions of the present invention can be installed onto the frame of a building under construction by one worker. Each stanchion is fitted so that the U-shaped space defined by facia nailing flanges 220, bracket bottom connectors 230, and back bracket arm 240 embraces the facia board 42 of the frame snugly. (This space is best visualized from FIG. 2.) Nails 46 are driven through facia nailing flange nail holes 222R and 222L into the facia board 42. Next, three nails 46 are driven all the way through the tubular rafter support arm 250, through nail holes 252, 254, and 256 into the rafter 44 of building frame. (All three holes are shown in FIG. 2.) A stanchion may be placed and nailed to either side of a rafter 44, as long as one side of rafter support arm 250 aligns flush to the rafter 44. Also, rafter arm 250 does not have to be exactly parallel to rafter 44. Rafter support arm nail holes 252,254, add 256 are not aligned, as an extra precaution against the splitting of the rafter 44.

Next, as seen in FIG. 1, three rails 43A, 43B, and 43C are fitted into the rail holders 20A, 208, and 20C, with nails 46 driven through pairs of rail nail holes 21A, 21B and 21C and into rails 43A, 43B and 43C. The fall protection system consisting of our stanchions and dimensional lumber rails is able to withstand substantial force applied in any outward or downward direction, such as the force created by a person or object falling or sliding down the roof being constructed. This is because of the unique design of the bracket assembly 200 of the invention, which not only embraces the facia board 42, and is nailed to it in two places, but is also nailed to a rafter in three places.

We tested our stanchions of the preferred embodiment mounted along a "2×6" (3.81 cm×13.97 cm) lumber facia board 42 and "2×4" (3.81 cm×8.89 cm) lumber rafters 44, using 16 penney nails 46. The stanchions were spaced at 8 foot (2.44 M) intervals, and supported "2×4" (3.81 cm×8.89 cm) lumber rails 43A, 43B, and 43C. The nails used for mounting the rails into the rail holders 20A, 20B, and 20C were 16 penney. The vertical post 10-front bracket member 210, and back bracket arm 240—rafter support arm 250 were fabricated from 1¼"×1¼"×⅛" (3.18 cm×3.18 cm×0.32 cm) square tube steel, and the rail holders 20A, 20B and 20C, the facia nailing flanges 220R and 220L, and the bracket bottom connector plates 230R and 230L were made of 3/16" (0.48 cm) thick plate steel. The stanchions measured 42 inches (1.07 M) upwards from the facia edge. The top rail 43A withstood the 200 pounds of force required by OSHA in a completely outward direction, and also 200 pounds in a completely downward direction, as well as 200 pounds in several combinations of downward and outward directions with a large margin of safety in all cases.

As is apparent from FIG. 1 and FIG. 2 and FIG. 3, the vertical post 10 of this invention, and the rails which it supports 43A, 43B and 43C, stand out from the facia board 42, so that the entire roofing process, including sheathing, gutter apron or de-edging, tar papering, and all shingling, may be completed with the fall protection system in place. This is true also of the siding operation—the stanchions need only be removed for application of facia wrap and soffit, which does not need to be applied by workers on the roof.

Other versions of this invention can be made using rectangular tube metal or round pipe for the parts made from square tube metal in the preferred embodiment. Also, other materials besides metal could be used. Shapes can be altered slightly also (for example, square corners on the rail holders 20A, 20B and 20C). Also, the angle A between vertical post 10 and front bracket member 210 may be varied to make the rail assembly stand out more or less distance from a roof. Similarly, the angle B where back bracket arm 240 joins rafter support arm 250 may be varied to accommodate roofs of different pitch. In fact, if this last angle mentioned is 90 degrees, the stanchion could be attached to a flat roof, or a floor or deck.

Figure 4:
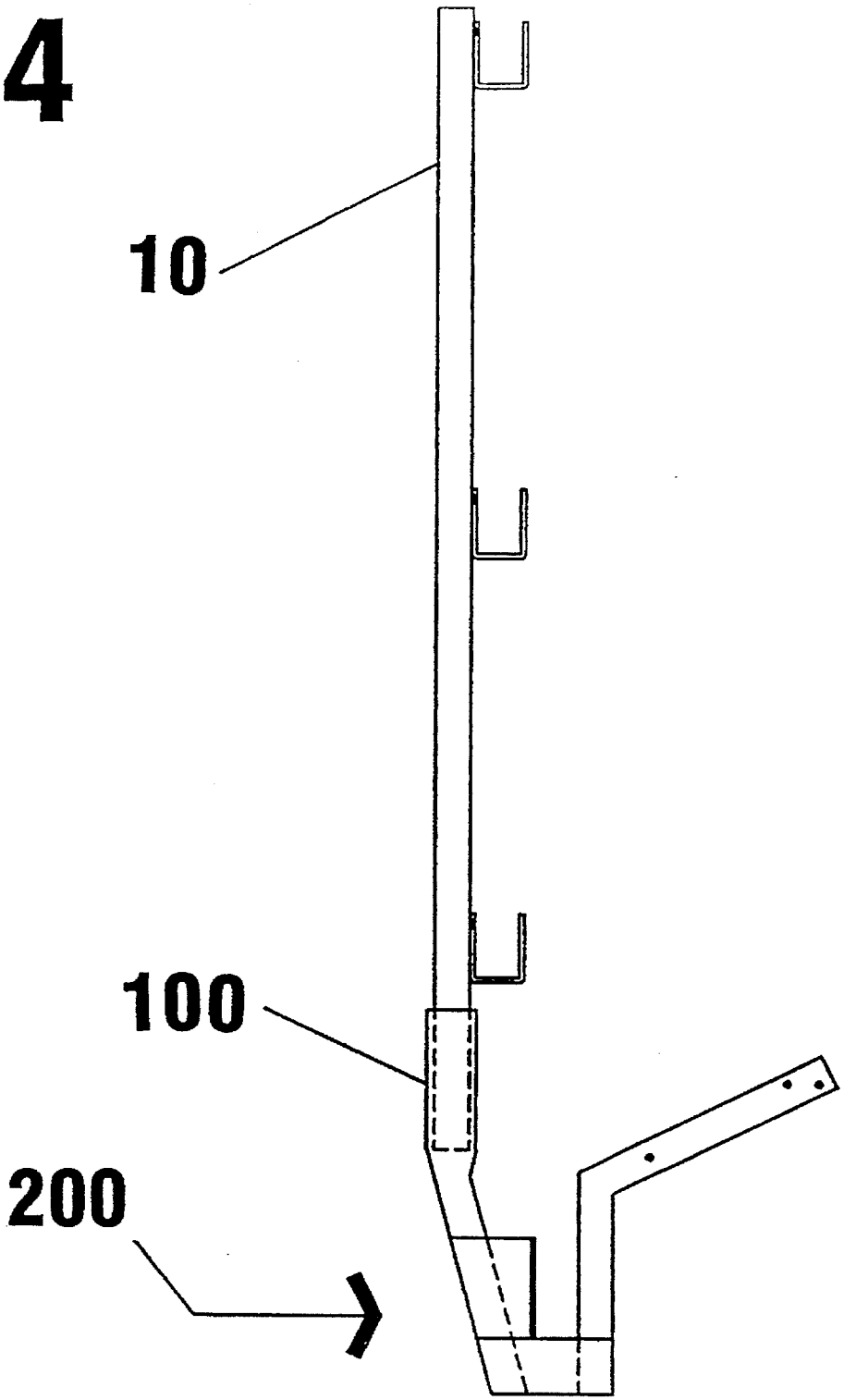
FIG. 4 illustrates a two-piece embodiment.

FIG. 4 This stanchion can also be made with the vertical post 10' separate from bracket assembly 200. Post 10' can then be fitted to a sleeve 100 of the same shape, but slightly larger measurements, joined to front bracket member 210 as post 10 is in the preferred embodiment. Separate post 10' can then be slipped into sleeve 100, and the stanchion will be assembled.

Thus the reader will see that the stanchion of this invention provides strong, reliable, easy to erect, and convenient fall protection for workers on a roof. Excellent strength is due to the unique bracket design, and also fall protection for workers, especially during all phases of the roofing process, without interfering with the siding operation.

We claim:

1. A stanchion comprising:

a post having an upper end and a lower end;

the post also including protection means for attaching at least one fall preventing device to the post; and attachment means, attached to the lower end of the post, for attaching the post to a rafter, wherein the attachment means includes embracement means positioned between the upper and lower ends for embracing a facia board.

2. The stanchion as recited in claim 1 wherein the protection means for attaching the fall preventing device comprises a plurality of rail holders attached to the post.

3. The stanchion as recited in claim 1 wherein the post extends substantially vertically when attached to the frame of a roof.

4. The stanchion as recited in claim 1 wherein the lower end of the post is integral with the attachment means that are formed to extend substantially parallel to a rafter.

5. The stanchion as recited in claim 1 wherein the post is separable from the attachment means.

6. The stanchion as recited in claim 1 wherein the embracement means includes a pair of flanges that are designed to extend outwardly and parallel to a facia board when the post is attached to a building.

7. The stanchion as recited in claim 1 wherein the fall preventing device comprises a rigid horizontal member.

8. The stanchion as recited in claim 1 wherein the fall preventing device comprises a strap.

9. The stanchion as recited in claim 1 wherein the fall preventing device comprises netting.

10. A guard rail comprising at least two stanchions, each stanchion comprising:

a post having an upper end and a lower end;

protection means, positioned on the post, for attaching at least one fall preventing device to the post;

the lower end of the post includes attachment means for attaching the post to a rafter; and the post further includes embracement means for embracing a facia board.

11. The guard rail as set forth in claim 10 wherein the fall preventing device comprises a rigid horizontal member.

12. The guard rail as set forth in claim 10 wherein the fall preventing device comprises a strap.

13. The guard rail as set forth in claim 10 wherein the fall preventing device comprises netting.

14. The guard rail as set forth in claim 10 wherein the protection means includes a plurality of rail holders.

15. The guard rail as set forth in claim 10 wherein the post extends substantially vertically when attached to the frame of a roof.

16. The guard rail as set forth in claim 10 wherein the lower end of the post is integral with the attachment means that are formed to extend substantially parallel to a rafter.

17. The guard rail as set forth in claim 10 wherein the lower end of the post is separable from the attachment means.

18. The guard rail as set forth in claim 10 wherein the embracement means includes a pair of flanges that are designed to extend outwardly and parallel to a facia board when the post is attached to a building.

* * * * *